US005344217A

United States Patent [19]

McLaughlin

[11] Patent Number: 5,344,217

[45] Date of Patent: Sep. 6, 1994

[54] ERGONOMIC FOOT REST

[75] Inventor: Richard S. McLaughlin, Plano, Tex.

[73] Assignee: Levi Strauss & Co., San Francisco, Calif.

[21] Appl. No.: 935,589

[22] Filed: Aug. 26, 1992

[51] Int. Cl.[5] ..... A47C 7/50

[52] U.S. Cl. ..... 297/423.25; 297/423.35

[58] Field of Search ..... 297/439, 437, 436, 433, 297/423.35, 423.25; 248/397

[56] References Cited

U.S. PATENT DOCUMENTS

| | | | |
|---|---|---|---|
| 619,071 | 2/1899 | Criddle | 297/437 |
| 792,644 | 6/1905 | Barber | 297/439 |
| 815,046 | 3/1906 | Sherman | 297/439 X |
| 1,542,508 | 6/1925 | Koenigkramer | 297/423.35 X |
| 1,936,942 | 11/1933 | Koenigkramer | 297/423.35 X |
| 2,578,488 | 12/1951 | Placerean | 297/433 X |
| 2,918,964 | 12/1959 | Braun | 155/171 |
| 4,062,605 | 12/1977 | Peters | 297/437 X |
| 4,063,321 | 12/1977 | Nichols | 9/7 |
| 4,287,835 | 9/1981 | Stratton | 297/439 X |
| 4,427,234 | 1/1984 | Peters | 297/439 |
| 4,767,160 | 8/1988 | Mengshoel et al. | 297/437 X |
| 4,768,831 | 9/1988 | Liedberg et al. | 297/437 X |
| 4,848,842 | 7/1989 | Stringham | 297/431 |
| 4,915,450 | 4/1990 | Cooper | 297/423 |
| 5,039,054 | 8/1991 | Pai | 297/345 X |
| 5,152,581 | 10/1992 | Norsworthy | 297/437 |

FOREIGN PATENT DOCUMENTS 1010017 of 0000 Canada .

*Primary Examiner*—Peter M. Cuomo
*Assistant Examiner*—Jerry Redman
*Attorney, Agent, or Firm*—Haverstock, Medlen & Carroll

[57] ABSTRACT

A foot platform is provided which can be adjusted horizontally towards and away from an operator, up or down relative to the operator, and angularly between vertical and horizontal to provide a comfortable platform for the operator to rest a foot during operation of a piece of equipment, and optionally including an attachment for a foot pedal actuating device so that a seated operator can control the foot pedal with either foot while resting the other foot on a foot rest of the present invention.

11 Claims, 3 Drawing Sheets

ERGONOMIC FOOT REST

TECHNICAL FIELD OF THE INVENTION

This invention relates generally to work stations. In particular, the present invention relates to foot rests used in conjunction with work stations.

BACKGROUND OF THE INVENTION

Certain workers involved in repetitive tasks, for example typists and machine operators, complain of fatigue and may suffer injury due to the positioning of parts of their body relative to their work surface. The ergonomic design of workstations is intended to prevent injury, alleviate such fatigue, and thus increase productivity.

It is well known to attach a support to a chair or other seating surface for supporting a control mechanism or for providing leg support, and thus provide for the comfort, of persons who remain seated for an extended period of time. This is generally shown in U.S. Pat. Nos. 4,848,842 to Stringham, 4,063,321 to Nichols; and 2,918,964 to Braun, which disclose seats with attached and dedicated leg or foot supports. No provision is made for supporting, in a selective position, the foot of a standing person, or of a person using a variety of conventional seating structures.

U.S. Pat. No. 4,915,450 to Cooper discloses a special workstation adapted to a specific piece of machinery, such as a computer. Cooper's workstation includes a chair, a device carriage and a footrest assembly coupled to and selectively pivotable about a shaft. While such a workstation enables a worker to selectively vary his position, it requires the worker to be seated and thus would not be suitable for a worker who normally stands. Further, such a solution would require scrapping existing work stations and the purchase of new (and dedicated) workstations, and would thus be quite costly.

Thus, the need exists for an economical adjustable foot rest which can be attached to or associated with a variety of conventional work stations, which is capable of adjustment vertically, horizontally, and angularly, and which can be selectively used by a standing worker or by a seated worker using a variety of conventional chairs, stools or other seating structures.

SUMMARY OF THE INVENTION

The present invention provides an adjustable ergonomic foot rest having a foot platform which is adjustable towards and away from a user, up or down relative to the floor, and angularly between a vertical and a horizontal position, and which can used selectively by a standing worker or by a worker seated on any seating surface.

In one embodiment, the present invention provides a work station foot rest which is capable of adjustment vertically, horizontally, and angularly.

In another embodiment, the present invention provides a work station including a foot rest which can be adjusted vertically, horizontally and angularly, and which can be used selectively by a standing worker or by a seated worker.

Other and further embodiments will become apparent upon consideration of the drawings and the detailed specification.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
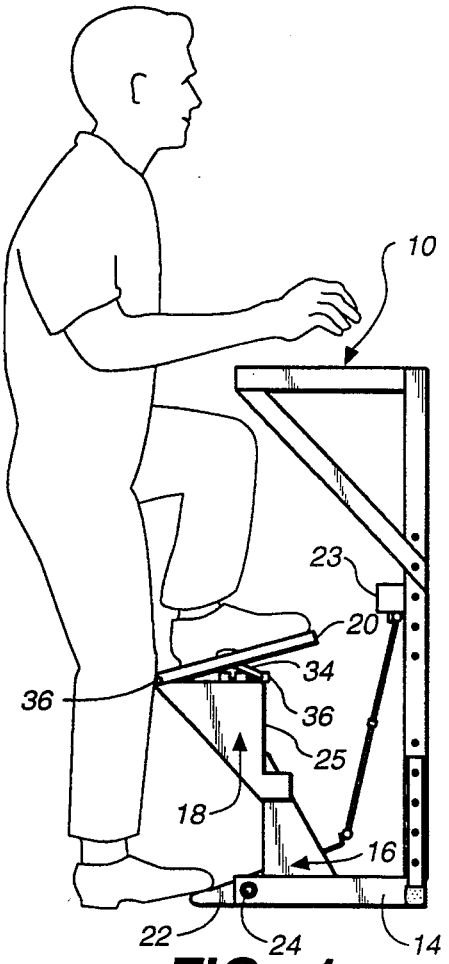
FIG. 1 is a side view of a work station showing a standing worker and including an adjustable ergonomic foot rest of the present invention.
Figure 2:
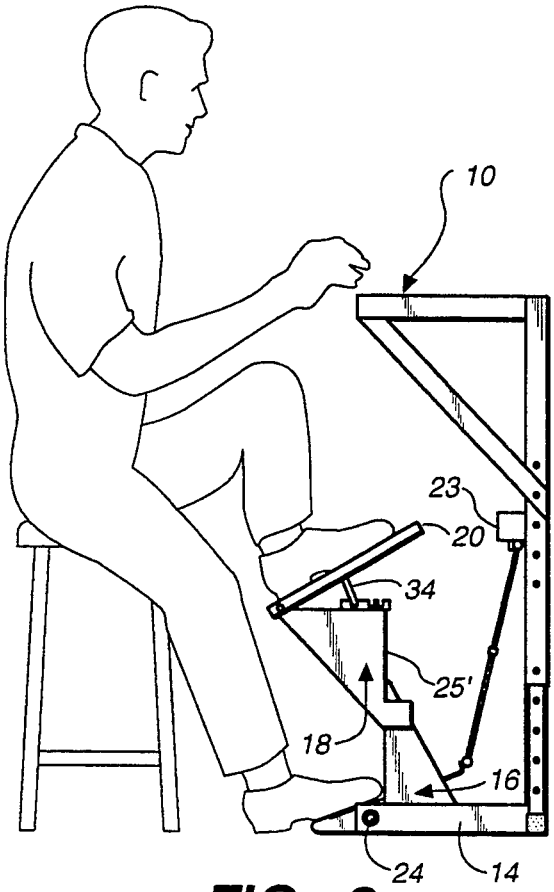
FIG. 2 is another side view of a work station showing a seated worker and including an adjustable ergonomic foot rest of the present invention.

As shown in FIGS. 1 and 2, a workstation 10 can be advantageously used by a standing or a sitting worker. Typically associated with the workstation 10 is a machine control pedal 22 and an on/off or a variable speed control 23 for controlling the operation of a machine (not shown). Also associated with the workstation 10 is an adjustable ergonomic foot rest 12 of the present invention.

As shown in more detail in FIGS. 3–6, an adjustable ergonomic foot rest of the present invention includes a base plate 14. A horizontally adjustable member 16 is movably attached to base plate 14, for example by providing key hole slots 28 along two substantially parallel bottom flanges 17, 17' attached to the sidewalls 19, 19' and the frontwall 15 of the horizontally adjustable member 16. The key hole slots 28 are aligned horizontally along the direction of movement. Studs 26, 26', 26'', 26''', 26'''' can be provided which are threaded into holes having mating threads provided in the base plate 14 and aligned with the keyhole slots 28 so that the keyhole slots 28 can be placed over the studs 26 at the widest part of the keyhole and then horizontally moved by sliding the flanges in a direction away from the operator's control pedal 22 so that the narrowest part of the keyhole is placed under the heads of the studs 26, thus preventing removal of the slots 28 from under the heads of the studs 26. In this embodiment, the studs 26 can then be tightened to removably secure the horizontally adjustable member 16 in a desired incremental horizontal position relative to the base plate 14. Alternatively, one could also provide for continuous horizontal adjustment by providing a single long slot, rather than an aligned row of keyhole slots, along each flange 17, 17' to cooperate with one or more locking bolts threaded into holes provided for this purpose in the base plate 14 and tightened to lock the horizontally adjustable member 16 in any desired position along the long slots relative to the base plate 14.

As shown in FIGS. 1–5, the horizontally adjustable member 16 also preferably includes a front wall 15 having two spaced apart, substantially parallel, vertically aligned rows of keyhole slots 28', one vertical row on each front flange 13. On each row, the keyhole slots are preferably oriented with the widest portion of the slot in an "up" position and the narrowest portion in a "down" position. These slots cooperate with studs 26 threaded into rear flanges 25, 25' of the vertically adjustable member 18. Thus, a desired vertical height can be incrementally selected by loosening the studs 26 to provide a space between the head of each stud 26 and the rear flanges 25, 25', placing the heads of the studs 26 of the vertically adjustable member 18 into the widest portion of the keyhole slots 28 located on the front wall 15 of the horizontally adjustable member 16 at the desired height, and permitting the studs 26 to drop into the slot 28 so that the head of each stud 26 bears against the front wall 15 of the horizontally adjustable member 16. The studs 26 can then be rotated to tighten the heads of the studs 26 against the front wall 15 of the horizontally adjustable member 16 to secure vertical position of the vertically adjustable member 18.

Alternatively, and as noted above for adjusting the horizontal position, the vertical position of the vertically adjustable member 18 can be made continuously adjustable by providing a single continuous slot in place of each vertically aligned row of keyhole slots along the front wall 15 of the horizontally adjustable member, and by providing one or more threaded locking bolts for threading into holes provided for that purpose in the rear flanges 25, 25' of vertically adjustable member 18 to lock the vertically adjustable member 18 in any desired position along the long slot.

More preferably, due to ease of adjustability, studs 26 can be welded into position so that the distance between the stud head 37 and the top surface of the base plate 14 is only slightly larger than the thickness of the flanges 13, 13', 17, 17'. Thus, when the widest part of the keyhold slots 28 are placed over the stud heads 37 and then horizontally moved so that the narrowest part of the keyhole is located under the stud heads 37, a snug fit is achieved. In this embodiment, due to the orientation of the keyhole slot 28, gravity, in combination with the force exerted by the operator during use, will maintain the relative position of the horizontally adjustable member 16 relative to the base plate 14, and the relative position of the vertically adjustable member 18 relative to the horizontally adjustable member 16. The position can be changed by moving the part having the studs 26 in an opposite direction, to place the stud heads 37 underneath the widest portion of the keyhole slot 28 to effect removal and subsequent adjustment of the parts to a different relative position.

Figure 6:
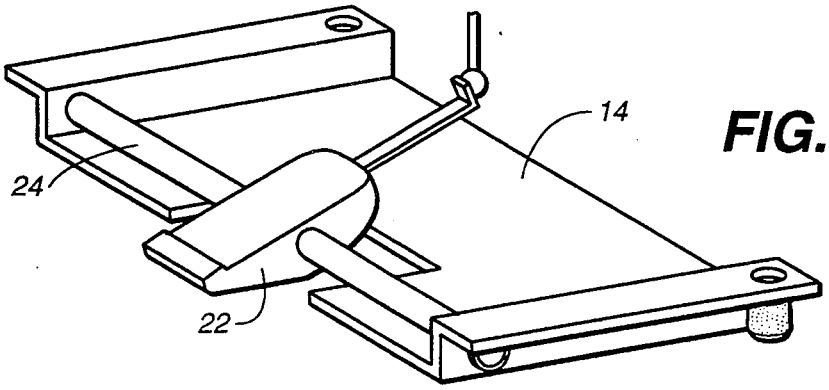
Figure 3:
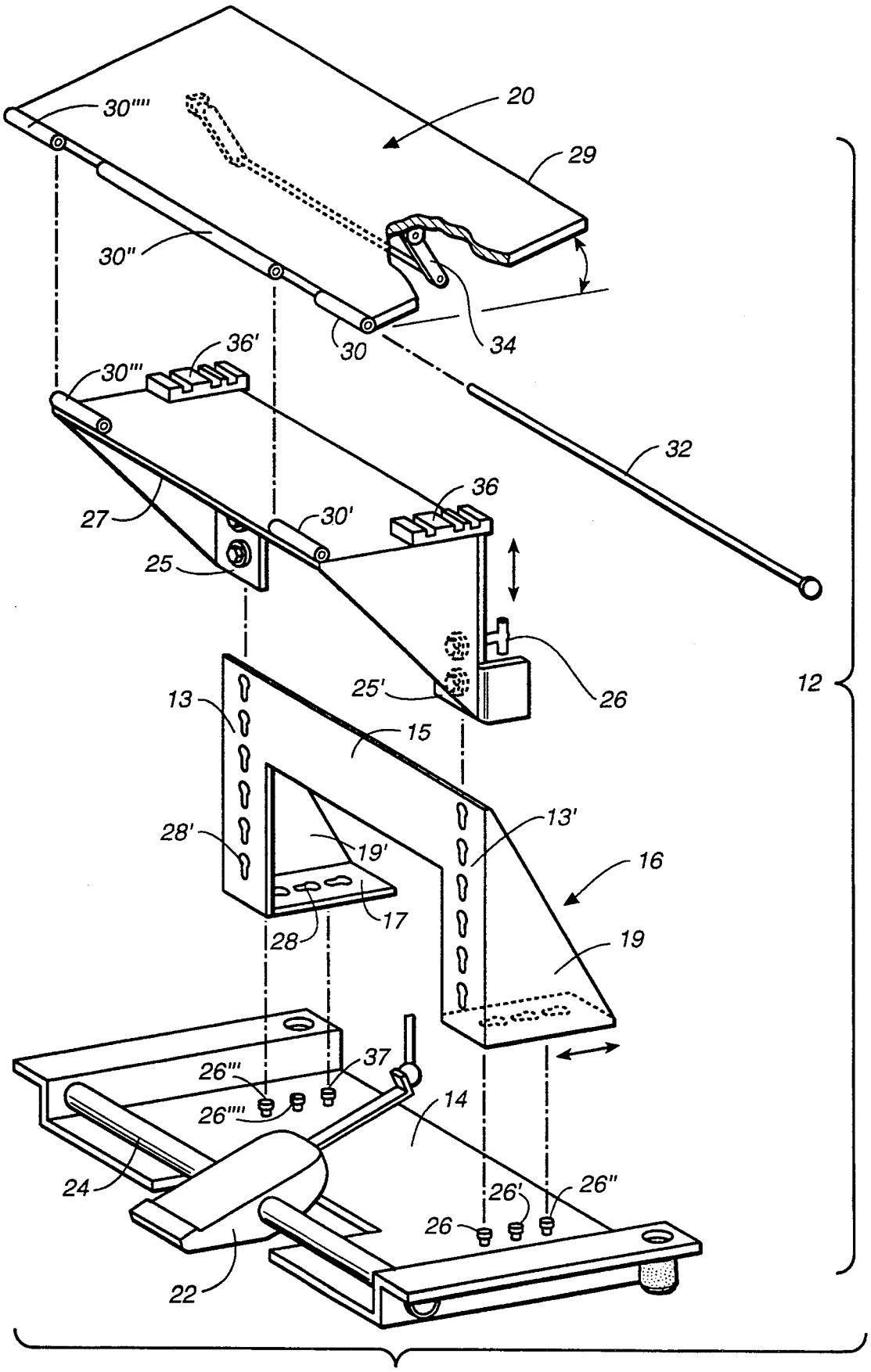
FIG. 3 is an enlarged, perspective, exploded view of an adjustable ergonomic foot rest of the present invention
Figure 5:
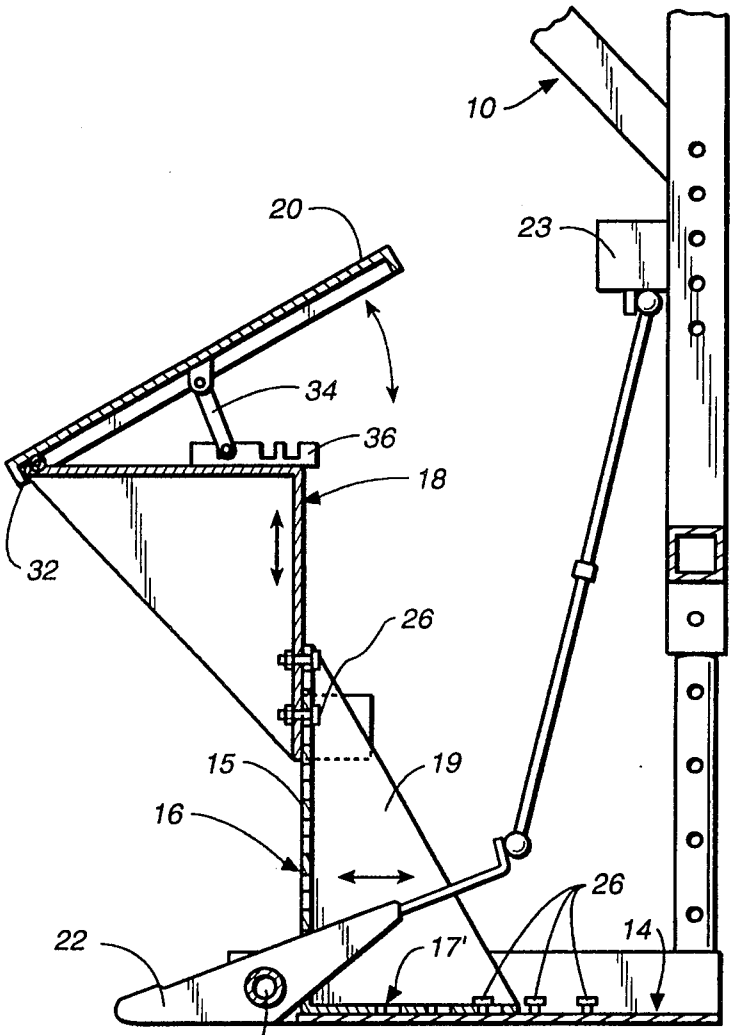
FIG. 5 is an enlarged side view of an adjustable ergonomic foot rest of the present invention; and, FIG. 6 is a perspective view of a base plate for an adjustable ergonomic foot rest of the present invention showing a preferred tang type fastener.
Figure 4:
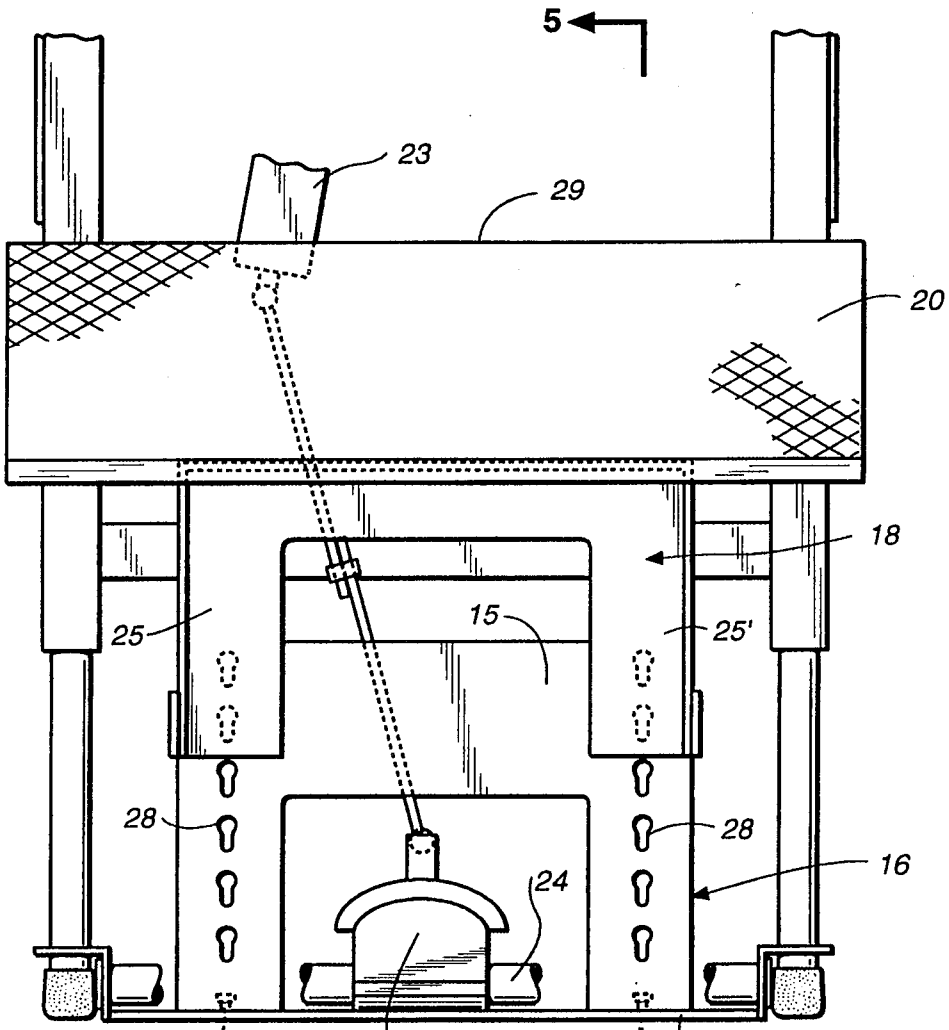
FIG. 4 is an enlarged top view of an adjustable ergonomic foot rest of the present invention.

Most preferably, as shown in FIG. 6, tangs 38 can be used in combination with key hole slots 28 to achieve secure positioning and easy adjustability of the horizontally adjustable member 16 and the vertically adjustable member 18. Each tang 38 has a tang head 39 which is offset above the surface to which the tang 38 is secured by tang arm 40, e.g., rear flanges 25, 25' and base plate 14. Tang arm 40 extends substantially perpendicularly from the surface to which the tang 38 is secured to one end of the tang head 39. The other end of the tang head 38 extends away from tang arm 40. In this embodiment, the width of the tang head 39 is preferably slightly smaller than the width of the narrow portion of the keyhole slot 28, and the length of the tang head from is sufficiently long so that at least a portion of the tang head 39 will extend over the surface of flanges 13, 13', 17, or 17' when the key hole slot is placed over the tang head 39 and moved horizontally to place the narrow end of the slot under the tang head 39 and adjacent to or abutting the tang arm 40. A snug fit is obtained by selecting a tang 38 which has a tang arm 40 with a length only slightly larger than the thickness of the flanges 13, 13', 17, 17' into which the keyhole slots 28 are cut. The relative orientation of the tangs 38 and keyhole slots 28 are preferably as shown in the drawings. Alternatively, one could reverse the location of these cooperating elements, for example by placing tangs on the front flanges 13, 13' and keyhole slots in the rear flanges 25, 25' or by placing tangs on the bottom flanges 17 and keyhole slots in the base plate 14. In this alternative position, the orientation of the parts will change: for example, tangs placed on the front flanges 13, 13' will be oriented so that the tang arm 40 is below the second end of the tang head 39, and the cooperating keyhole slots on rear flanges 25, 25' will be oriented so that the wide portion of the keyhole slot 28 is located below the narrow portion.

Angular adjustment is provided by mounting a foot platform 20 to the proximal edge 27 of the vertically adjustable member 18 using a hinge. Thus, when the hinge barrel members 30, 30'' and 30'''' on the foot platform 20 are aligned with the mating hinge barrel members 30' and 30''' on the proximal edge 27 of the vertically adjustable member 18, and are pivotally secured together by sliding the hinge pin 32 into the receiving barrel members, the foot platform is capable of rotating about the hinge pin 32. A pivoting catch 34 may be provided on the bottom surface of the foot platform 20 to cooperate with a catch receiver 36 mounted on the top surface of the vertically adjustable member. This allows the foot platform to be held at a desired angle until changed by lifting up the distal end 29 of the foot platform 20 to remove the pivoting catch from the catch receiver 36. The foot platform 20 can then be positioned at a desired angle and secured in place by placing the pivoting catch 34 in a groove in the catch receiver 36 which will retain the foot platform 20 at or near the selected desired angle. The pivoting catch 34 and the catch receiver 36 can be oriented to permit an angular adjustment of the top surface of the foot platform 20 from nearly vertical to horizontal.

As shown in FIGS. 3–6, means can be provided for attaching an operator's control pedal 22 to an ergonomic foot rest of the present invention. The operator's control pedal 22 can be pivotally attached to the center portion of base plate 14 using a rod 24. This permits the pedal 22 to rotate about the rod 24, allowing the front portion of the pedal 22 to be depressed, thus actuating the machinery associated with the workstation 10. By locating the control pedal 22 in the center of the base plate 14, the operator can operate the control pedal 22 with either foot, and rest the other foot on the ergonomic foot rest if desired. In this configuration, the foot rest may be used by a standing operator (as shown in FIG. 1) or by a seated operator (as shown in FIG. 2).

To use a foot rest of the present invention, the operator preferably adjusts the horizontal position first, followed by the vertical position and, finally, the angular position of the foot platform 20. The horizontal position of the foot platform 20 is adjusted by moving the foot platform 20, attached vertically adjustable member 18, and attached horizontally adjustable member 16 as a unit proximally so that the widest part of the keyhole slot 28 is placed under the heads of each stud 26 (or where tang fasteners are used, adjacent to the tang arm 40) in the base plate 14, permitting the foot platform 20 and attached vertically adjustable and horizontally adjustable members to be separated from the base plate 14. A desired horizontal position is then selected, and the widest part of the nearest keyhole slot 28 in the bottom flange 17, 17' of horizontally adjustable member 16 is dropped over the heads of the studs 26 (or where tang fasteners are used, over the tang head) in the base plate 14. The foot platform 20 and attached vertically adjustable and horizontally adjustable members are moved as a unit distally so that the narrowest part of the keyhole slot in the bottom flange 17, 17' is positioned under the head of each stud 26 (or under a tang head and adjacent to the tang arm where tang fasteners are used) in the base plate 14, to secure the position of the foot platform 20 relative to the base plate 14.

Vertical positioning of the foot platform 20 is achieved by lifting up on the foot platform 20 and attached vertically adjustable member 18 as a unit to move the head of each fastener 26 or 38, so that it is positioned behind the widest portion of its keyhole slot in the front wall 15 of horizontally adjustable member 16. The foot platform 20 and attached vertically adjustable member 18 can then be separated from the horizontally adjustable member 16. A desired vertical position for the foot platform 20 can then be selected, and the head of each fastener 26 or 38 on the rear flanges 25, 25' of the vertically adjustable member can be inserted into the widest portion of the nearest keyhole slots on the front wall 15 of the horizontally adjustable member 16. The head of each fastener 26, 38 should be permitted to slide into the narrowest portion of each selected keyhole slot, so that the head of each fastener 26, 38 bears against the front flanges 13, 13' of the horizontally adjustable member 16 to secure the vertical position of the foot platform 20 and attached vertically adjustable member 18 relative to the base plate 14 and the front wall 15 of the horizontally adjustable member 16.

Angular positioning of the foot platform 20 is achieved by lifting up the distal end 29 of the foot platform 20 to remove the pivoting catch from the catch receiver 36, positioning the foot platform at a desired angle, and placing the pivoting catch 34 in the nearest groove in the catch receiver 36 which will retain the foot platform 20 at or near the selected desired angle.

One skilled in the art will recognize that while the preferred embodiments have been described in detail, and shown in the accompanying drawings, one skilled in the art will recognize that various further modifications are possible without departing from the scope of the invention as set forth in the appended claims.

I claim:

1. An ergonomic foot rest associated with a work station and comprising:

a stable, substantially horizontal base;

a first member movably attached to said base to permit horizontal adjustment of said first member along the base to a desired position, wherein said first member is moved in a horizontal plane;

a second member movably attached to said first member to permit vertical adjustment of said second member along said first member to a desired height, wherein said second member is moved in a vertical plane;

a footplate attached pivotally to the second member to permit adjustment of the footplate whereby a top surface of said footplate is secured at a desired angle between a vertical position and a horizontal position relative to said base;

said base including a means for pivotally attaching to said base a foot activated control pedal associated with the work station, whereby a user can operate said foot pedal with a first foot while simultaneously resting a second foot on said footplate.

2. The foot rest of claim 1 in which said first member is adjustable in increments to preselected positions.

3. The foot rest of claim 1 in which the second member is adjustable in increments to preselected positions.

4. The foot rest of claim 1 additionally comprising a means for releasably securing said first member against movement once a desired horizontal position is selected.

5. The foot rest of claim 1 additionally comprising a means for releasably securing said second member against movement once a desired height is selected.

6. A work station comprising:

a means for controlling equipment used by an operator;

a foot rest located adjacent to said means for controlling equipment, said foot rest including a substantially stable base, a first member movably attached to said base to permit selective horizontal positioning of the first member relative to the base by moving said first member in a horizontal plane, a second member movably attached to the first member to permit selective vertical positioning of said second member relative to the first member by moving said second member in a vertical plane, a footplate having a top surface and movably attached to said second member.

a means for selectively securing the angular position of the top surface of said footplate in a position between a vertical position and a horizontal position relative to said base;

and wherein said means for controlling equipment is a foot activated control pedal pivotally connected to said base, whereby said operator can engage said means for controlling equipment with a first foot while simultaneously resting a second foot on said footplate.

7. The work station of claim 6 in which said footplate is pivotally attached to said second member.

8. The work station of claim 7 in which said footplate is attached to said second member along a proximal edge of said footplate.

9. The work station of claim 6 additionally including a means for releasably securing said first member against movement once the desired horizontal position has been selected.

10. The work station of claim 6 additionally including a means for releasably securing said second member against movement once the desired vertical position has been selected.

11. The work station of claim 6 in which said base includes a means for securing said foot pedal centrally on said base.

* * * * *